United States Patent [19]

Wiechert

[11] 4,287,399

[45] Sep. 1, 1981

[54] SWITCH DEVICE FOR A RAIL-BOUND TRANSPORT CAR FORMED OF A TRAVELING CARRIAGE AND A TRANSPORT CONTAINER THAT CAN BE PLACED AND LOCKED ONTO THE TRAVELING CARRIAGE

[75] Inventor: Edelbert Wiechert, Berlin, Fed. Rep. of Germany

[73] Assignee: Siemens Aktiengesellschaft, Berlin & Munich, Fed. Rep. of Germany

[21] Appl. No.: 76,854

[22] Filed: Sep. 19, 1979

[30] Foreign Application Priority Data

Sep. 22, 1978 [DE] Fed. Rep. of Germany ..... 2841820

[51] Int. Cl.[3] ..... H01H 3/00

[52] U.S. Cl. ..... 200/153 T; 200/153 V; 200/330; 200/340

[58] Field of Search ..... 200/153 T, 329, 330, 200/331, 332, 335, 336, 337, 338, 340, 153 H, 153 V

[56] References Cited

U.S. PATENT DOCUMENTS

| | | | |
|---|---|---|---|
| 3,123,690 | 3/1964 | Gondek | 200/153 T |
| 3,340,821 | 9/1967 | Wesener | 104/88 |
| 3,969,599 | 7/1976 | Terry | 200/335 |

FOREIGN PATENT DOCUMENTS

| | | | |
|---|---|---|---|
| 222391 | 7/1962 | Austria | 200/153 T |
| 50-84274 | 1/1977 | Japan | 200/153 T |
| 1467308 | 3/1977 | United Kingdom | 200/340 |
| 156982 | 3/1962 | U.S.S.R. | 200/153 T |

*Primary Examiner*—John W. Shepperd

*Attorney, Agent, or Firm*—Hill, Van Santen, Steadman, Chiara & Simpson

[57] ABSTRACT

In the exemplary embodiments, an actuating element projecting from the basic transport carriage and deflectable by means of the transport container is designed as a tappet which bears against a two-arm lever with a projection; the second arm of the lever lies against a switch control element of a switch device and is under the influence of a second spring force directed against the first spring force and dimensioned smaller than the first spring force. Such switch devices are employed as monitoring switches for a transport car composed of a carriage and a transport container which can be placed thereon.

6 Claims, 3 Drawing Figures

SWITCH DEVICE FOR A RAIL-BOUND TRANSPORT CAR FORMED OF A TRAVELING CARRIAGE AND A TRANSPORT CONTAINER THAT CAN BE PLACED AND LOCKED ONTO THE TRAVELING CARRIAGE

BACKGROUND OF THE INVENTION

In transport systems in which transport cars run on profile rail lines and receive their drive energy from current paths proceeding along the profile rail lines, the transport cars often serve for the transport of the most various goods. For example, files, hardware for a mechanical fabrication, rolls of drawings, or laboratory samples stored in test tubes or similar glass vessels, are transported. In this connection, it is known to employ different transport containers which are specially adapted to specific goods. Thus, for example, large cylindrical containers are employed for transporting rolls of drawings, and containers with rotatable receptacles are employed for transporting test tubes so as to guarantee a vertical alignment of the test tubes in any position (angular attitude) of the transport car. It is further known to construct the transport car so that the basic self-propelled chassis or carriage including the drive motor, control devices and the transport rollers, detachably mounts a separate transport container, whereby the basic transport chassis or carriage can be coupled by means of a correspondingly adapted locking device with any of a number of different transport containers to form a transport car unit.

This method of building up a transport car from a basic transport carriage and a transport container which can be released therefrom implies a number of monitoring problems. Thus, for example, it is usually demanded that the basic transport carriage be able to travel along the profile rail lines without a transport container placed onto it. This possibility is useful, for example, since it enables the delivery of the transport carriage to a dispatching station where special containers are always present in response to a request issued by such dispatching station. On the other hand, the travel of the transport carriage with transport containers only loosely in place but not locked is to be prevented for reasons of safety. Beyond that, as in transport cars in which the actual transport container and the transport carriage form a structural unit, it must be insured that a departure of the transport car is impossible when the cover of the transport container is not closed. For such monitoring tasks, among other things, a contact device is employed on the transport chassis or carriage which may be influenced by means of a transport container resting on the transport carriage. Thereby, for example, the contact device can be inserted in a drive current circuit of the transport chassis or carriage in such manner that the driving current circuit is closed without a transport container put in place, but, on the other hand, is interrupted when a transport container is loosely or firmly put in place. A second driving current circuit can be connected in parallel to this current circuit, which second current circuit includes a cover locking contact and a locking contact proceeding over the locking device for the transport carriage and transport container and which, accordingly, only allows a driving current circuit for the transport car when both the transport container is firmly placed and locked onto the transport carriage, and the cover of the transport container is closed.

SUMMARY OF THE INVENTION

The invention relates to a monitoring of the presence of a transport container on the basic transport chassis or carriage and, accordingly, proceeds from a switch device for a rail-bound transport car consisting of a basic carriage with an electric motor and brushes for drawing off electric energy from live rails, and of a transport container that can be placed and locked onto the carriage, said transport car having an adjusting element of a contact device which can be altered in its position by means of an actuation element projecting from the transport carriage and deflectable by the transport container.

The object of the invention is to design this switch device in such manner that a positive response of the contact device is achieved upon the loose emplacement of a transport container or any other random object on the actuation element i.e. already upon short deflection paths of the actuation elements; in that, on the other hand, a relatively great overtravel of the actuation element is also not hindered after the traversal of the actual switching path. Thereby, it is essentially to be achieved that a transport container which rests loosely on the locking device of the transport carriage or, respectively, rests with one end area on the locking device and with the other on different device areas is already assured of causing an actuation of the contact device; that, on the other hand, given a transport container faultlessly put in place and, accordingly, greater proximity of the transport container bottom to the confronting surface of the transport carriage, no hindering of this approach by the actuation element or, respectively, no impairment of the functional security of the contact device ensues.

The object underlying the invention is achieved in that at least one part of the actuation element is designed as a tappet axially deflectable against the force of a spring, the tappet having a projection normally resting against the rear surface (as seen in the deflection direction) of one arm of a two-arm lever whose second arm rests against the adjustment element and is under the influence of a spring force directed against the force caused by the spring at the second arm and dimensioned smaller than this.

The advantage achieved with the invention particularly resides in the result that the arm of the two-arm lever resting against the adjustment element is under the influence of a spring force which, after the release of the other arm of the lever by means of the displacement of the tappet, rotates this arm and, in the course of the rotational movement, effects a change of the contact position of the contact device. Thereby, the spring force arising at the second arm of the lever can be realized by means of a spring of the contact device. For example, this spring can consist of the contact spring to be actuated, i.e. that the spring force occuring at the second arm of the lever is identical with the contact force.

Advantageous further developments of the invention provide that the two-arm lever is designed as a rocker equipped with a knife-bearing and exhibits a recess through which the tappet passes. By so doing, a design of the lever is achieved which is particularly simple from a structural point of view; in particular, one can make do without an expensive seating for the lever, since this is supported at a wall, particularly the carriage wall, with the edge separating the two arms of the rocker from one another. In this position, the rocker is held because of the penetration of the tappet through the recess and the influence of the tappet projection.

Further structural embodiments of the invention provide that the projection is formed by a disc secured to the tappet and that the projection is at the same time a bearing surface for a helical spring surrounding the tappet.

Therewith, the entire device consisting of tappet, spring and rocker can be assembled in a simple manner.

In the following, two exemplary embodiments of the invention are explained on the basis of the accompanying sheet of drawings; and other objects, features and advantages will be apparent from this detailed disclosure and from the appended claims.

DETAILED DESCRIPTION

Figure 1:
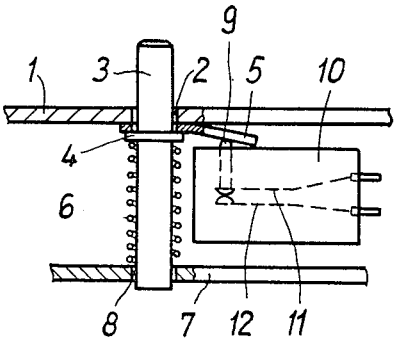
FIG. 1 is a somewhat diagrammatic partial sectional view illustrating a switch arrangement in accordance with the present invention, in the absence of any transport container-produced displacement of the switch actuator.

A bore 2 through which a longitudinally movable rod or tappet 3 passes is situated in a wall 1 forming a component part of a basic transport chassis or carriage. The rod 3 exhibits a disc 4 rigidly attached to it, which disc 4 serves as a projection for engaging the lower surface of a switching rocker 5. The rod 3 is surrounded by a helical compression spring 6 which is supported against the disc 4 at the upper end and assembly wall 7 at the lower end, which assembly wall 7 exhibits a bore 8 for the tappet 3.

In the switching position shown in FIG. 1, the second arm of the switching rocker 5 facing away from the tappet 3 presses a contact tappet 9 of a contact device 10 down so that a schematically indicated contact spring 11 is in contact with a counter-contact spring 12. The force exerted by the contact spring 11 and the counter-contact spring 12 is less than the spring force produced by the helical spring 6 (opposing a displacement of the tappet 3 toward the assembly wall 7).

Figure 2:
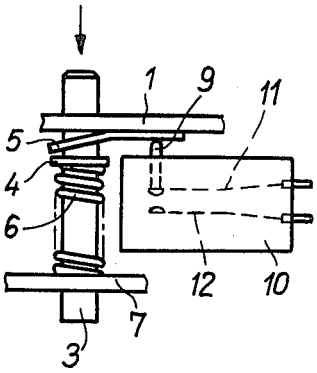
FIG. 2 is a view similar to FIG. 1, but showing the switch in actuated condition in response to a slight displacement of the switch actuator.

When placing a transport container on the basic transport carriage, the lower surface of the transport container strikes the tappet 3 and pushes this down (as indicated by the arrow in FIG. 2) against the force exerted by the helical spring 6. After only a short displacement of the tappet 3, as a result of the spring force exerted by the contact spring 11 away from the counter-contact spring 12 of the contact device 10, the switching rocker 5 is turned so far that the switching contact formed of the contact spring 11 and the counter-contact spring 12 is opened as shown in FIG. 2. Thereby, a driving current circuit for the carriage is interrupted to signal that a transport container is at least loosely associated with the transport carriage.

Figure 3:
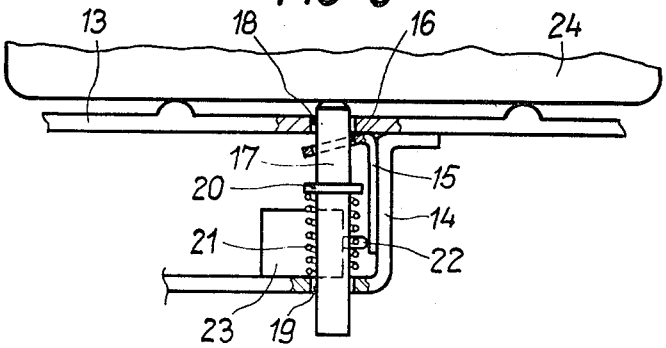
FIG. 3 illustrates a second embodiment with a transport container indicated as placing the switch in actuated condition.

The switch device shown in FIG. 3 is shown in the switching position of the switch device caused by placing a transport container 24 on the associated transport carriage.

A wall 13 again forming a partial area of the carriage of a transport car comprising a transport container and carriage exhibits a mounting angle 14 on which an L-shaped switching rocker 15 is supported. The switching rocker 15 has a bore 16 through which a tappet 17 passes. The tappet 17 can be longitudinally shifted through a bore 18 of the wall 13 and through a bore 19 of the mounting angle 14. The tappet 17 carries a clamped-on projection disc 20 at which a helical compression spring 21 is seated. In the illustrated position, the tappet 17 has been deflected by the lower surface of a transport container 24 so far that a contact tappet 22 of a contact device 23 turns the switching rocker 15 into the position shown. Thereby, a contact within the contact device 23 is switched in such manner that the driving current circuit of the traveling device is interrupted.

It will be apparent that many modifications and variations may be effected without departing from the scope of the novel concepts and teachings of the present invention.

I claim as my invention:

1. In a switch monitored assembly including a wall (1,13) and a container (24) which can be put in place against said wall in an initial relatively loose condition, and which can also be locked in place, a switch device comprising:

a pivotable two-arm lever (5,15) having a first arm movable from a first position to a second position in a first direction and having a leading surface with respect to said first direction of movement, said lever (5,15) having a second arm for effecting an actuating movement as said first arm moves from said first position to said second position, a contact device (10,23) having an actuating element actuatable in response to said actuating movement of said second arm, a first spring (6,21), a tappet (3,17) capable of axial excursion against the force of the first spring (6,21), said tappet (3,17) having a projection (4,20) for pressing against the leading surface of said first arm for holding said first arm in said first position, the improvement comprising:

(a) said tappet (3,17) projecting from said wall (1,13) for engagement with said container and being responsive to the application of the container to the wall (1,13) in the initial relatively loose condition to effect an initial travel over an initial distance thereby to release said lever (5,15) for movement from said first position to said second position, (b) a second spring acting on said lever to urge said first arm toward said second position but having insufficient force to overcome the action of the first spring (6,21), said lever upon initial travel of said tappet over said initial distance being pivoted under the influence of said second spring to move said first arm to said second position, (c) stop means (1 or 14) engageable with said lever (5,15) in the second position of said first arm and preventing further pivotal movement of the lever under the impetus of said second spring as said tappet (3,17) is moved beyond said initial distance, and (d) said tappet (3,17) being movable over a substantial distance beyond said initial distance as the container is locked in place relative to said wall (1,13), said projection (4,20) moving away from said leading surface of said first arm during the further travel of said tappet beyond said initial travel and said tappet (3,17) being decoupled from the lever (5,15) during the travel of said tappet beyond said initial travel as the container is locked in place relative to said wall (1,13).

2. An assembly according to claim 1, with the two-arm lever being in the form of a rocker having a knife-edge seating between the first and second arms.

3. An assembly according to claim 1, with the lever having a recess through which the tappet passes in the first and second positions of said first arm thereof.

4. An assembly according to claim 1, with the projection being in the form of a disc secured to the tappet.

5. An assembly according to claim 1, with the projection providing a bearing surface, said first spring comprising a helical spring surrounding the tappet and acting on said bearing surface.

6. An assembly according to claim 1, the second spring providing a resilient force directed against the force caused by the first spring and being provided by a spring (11,12) of the contact device (10).

* * * * *